US008189803B2

(12) United States Patent
Bergeron et al.

(10) Patent No.: US 8,189,803 B2
(45) Date of Patent: May 29, 2012

(54) NOISE REDUCTION HEADSET

(75) Inventors: Mark Bergeron, N. Grafton, MA (US); Stephen Crump, Wayland, MA (US); Daniel M. Gauger, Jr., Cambridge, MA (US)

(73) Assignee: Bose Corporation, Framingham, MA (US)

( * ) Notice: Subject to any disclaimer, the term of this patent is extended or adjusted under 35 U.S.C. 154(b) by 1120 days.

(21) Appl. No.: 10/868,318

(22) Filed: Jun. 15, 2004

(65) Prior Publication Data

US 2005/0276421 A1 Dec. 15, 2005

(51) Int. Cl.
*H04R 1/10* (2006.01)

(52) U.S. Cl. ..... 381/74; 381/71.6; 381/123

(58) Field of Classification Search ..... 381/1, 74, 381/13, 56–57, 71.1–71.14, 94.1–94.7, 3
See application file for complete search history.

(56) References Cited

U.S. PATENT DOCUMENTS

| | | | | |
|---|---|---|---|---|
| 4,455,675 | A | 6/1984 | Bose | |
| 4,494,074 | A | 1/1985 | Bose | |
| 4,593,696 | A | 6/1986 | Hochmair et al. | |
| 4,941,187 | A * | 7/1990 | Slater | 381/86 |
| 5,001,763 | A | 3/1991 | Moseley | |
| 5,105,377 | A | 4/1992 | Ziegler | |
| 5,276,740 | A | 1/1994 | Inanaga et al. | |
| 5,481,615 | A | 1/1996 | Eatwell et al. | |
| 5,604,813 | A * | 2/1997 | Evans et al. | 381/71.6 |
| 5,699,436 | A | 12/1997 | Claybaugh et al. | |
| 5,768,473 | A | 6/1998 | Eatwell et al. | |
| 5,815,582 | A | 9/1998 | Claybaugh et al. | |
| 5,825,897 | A * | 10/1998 | Andrea et al. | 381/71.6 |
| 6,108,426 | A * | 8/2000 | Stortz | 381/77 |
| 6,118,878 | A | 9/2000 | Jones | |
| 6,278,786 | B1 * | 8/2001 | McIntosh | 381/71.6 |
| 6,801,629 | B2 | 10/2004 | Brimhall et al. | |
| 6,952,481 | B2 * | 10/2005 | Larsen et al. | 381/74 |
| 7,110,800 | B2 * | 9/2006 | Nagayasu et al. | 455/575.2 |
| 7,215,766 | B2 * | 5/2007 | Wurtz | 379/430 |
| 7,590,254 | B2 | 9/2009 | Olsen | |
| 2001/0046304 | A1 * | 11/2001 | Rast | 381/74 |
| 2001/0050993 | A1 * | 12/2001 | Douglas | 381/71.6 |
| 2002/0141599 | A1 * | 10/2002 | Trajkovic et al. | 381/71.6 |
| 2003/0118197 | A1 | 6/2003 | Nagayasu et al. | |
| 2005/0213774 | A1 | 9/2005 | Kleinschmidt et al. | |
| 2005/0276421 | A1 | 12/2005 | Bergeron et al. | |

(Continued)

FOREIGN PATENT DOCUMENTS

EP 0548836 A1 6/1993

(Continued)

OTHER PUBLICATIONS

European Search Report dated Aug. 7, 2006 from European Application No. 05104712.4.

(Continued)

*Primary Examiner* — Xu Mei
*Assistant Examiner* — Fatimat O Olaniran
(74) *Attorney, Agent, or Firm* — Bose Corporation

(57) ABSTRACT

A noise reduction headset including a negative feedback active noise reduction signal processing path for providing active noise reduction, an electronic communication signal processing path, a talk-through signal processing path for providing talk-through capability, comprising at least one talk-through microphone separate from the electronic communication signal processing path, and a switching element for disabling one or both of the noise reduction signal path and the talk-through signal path.

14 Claims, 8 Drawing Sheets

U.S. PATENT DOCUMENTS

| | | | |
|---|---|---|---|
| 2006/0153394 | A1 | 7/2006 | Beasley |
| 2007/0038442 | A1 | 2/2007 | Visser et al. |
| 2007/0253569 | A1 | 11/2007 | Bose |
| 2008/0107287 | A1 | 5/2008 | Beard |
| 2009/0034748 | A1 | 2/2009 | Sibbald |
| 2009/0046868 | A1 | 2/2009 | Engle et al. |

FOREIGN PATENT DOCUMENTS

| | | | |
|---|---|---|---|
| EP | 0583900 | | 2/1994 |
| EP | 0643881 | | 3/1995 |
| EP | 0 548 836 | B1 | 6/1997 |
| EP | 935236 | A1 | 8/1999 |
| EP | 0 993 229 | | 4/2000 |
| EP | 1608202 | | 12/2005 |
| GB | 2431313 | | 4/2007 |
| JP | 06-070391 | | 3/1994 |
| JP | H 8-70493 | | 3/1996 |
| JP | 08-307986 | | 11/1996 |
| JP | 2001268684 | | 9/2001 |
| JP | 2006-14307 | | 1/2006 |
| WO | 93/25167 | | 12/1993 |
| WO | 9325167 | A1 | 12/1993 |
| WO | 9326085 | A1 | 12/1993 |
| WO | 9802016 | A2 | 1/1998 |
| WO | WO 98/02016 | | 1/1998 |
| WO | 9904597 | A2 | 1/1999 |
| WO | WO 99/04597 | | 1/1999 |
| WO | WO 2004/064443 | | 7/2004 |

OTHER PUBLICATIONS

International Search Report and Written Opinion dated Apr. 25, 2008 from International Application No. PCT/US2007/067496.

International Preliminary Report on Patentability dated Sep. 15, 2008 for PCT/US07/067496.

Chinese Office Action dated Mar. 13, 2009 in related CN Appl. No. 200510077928.0.

EP Examination dated Feb. 9, 2010 for EP 05104712.4-1224.

CN Office Action dated Feb. 12, 2010 for CN Appl. No. 200510077928.0.

CN Office action dated Jan. 20, 2011 for CN Appln. No. 200510077928.0.

CN Office Action dated Sep. 3, 2010 for CN 200780014891.4.

JP OA dated Nov. 2, 2010 for JP2005-174271.

CN Office Action dated May 25, 2011 for CN Appln. 200510077928.0.

* cited by examiner

NOISE REDUCTION HEADSET

BACKGROUND

The invention pertains to noise reduction headsets, and more particularly to noise reduction headsets having active noise reduction circuitry and talk-through circuitry.

SUMMARY OF THE INVENTION

In one aspect of the invention, a noise reduction headset includes active noise reduction circuitry for providing active noise reduction; talk-through circuitry for providing talk-through capability; and switching element for disabling one or both of the noise reduction circuitry and the talk-through circuitry.

In another aspect of the invention, a noise reduction headset includes a first signal path, including active noise reduction and talk-through; a second signal path, including talk-through and not including active noise reduction; a selection circuit constructed and arranged to select either the first signal path or the second signal path.

In another aspect of the invention, a noise reduction headset includes an active noise reduction signal path; and a talk through signal path, comprising a microphone and a frequency selective filter for filtering input from the microphone, the filter constructed and arranged to significantly attenuate frequencies not in the speech band.

In still another aspect of the invention, a method for operating a noise reduction headset containing an active noise reduction signal path and a talk-through signal path includes providing electrical power to the active noise reduction control signal path and to the talk-through signal path; in the event that the electrical power to the active noise reduction control signal path is below a first threshold level disabling the noise reduction control signal path.

DETAILED DESCRIPTION

Figure 1:
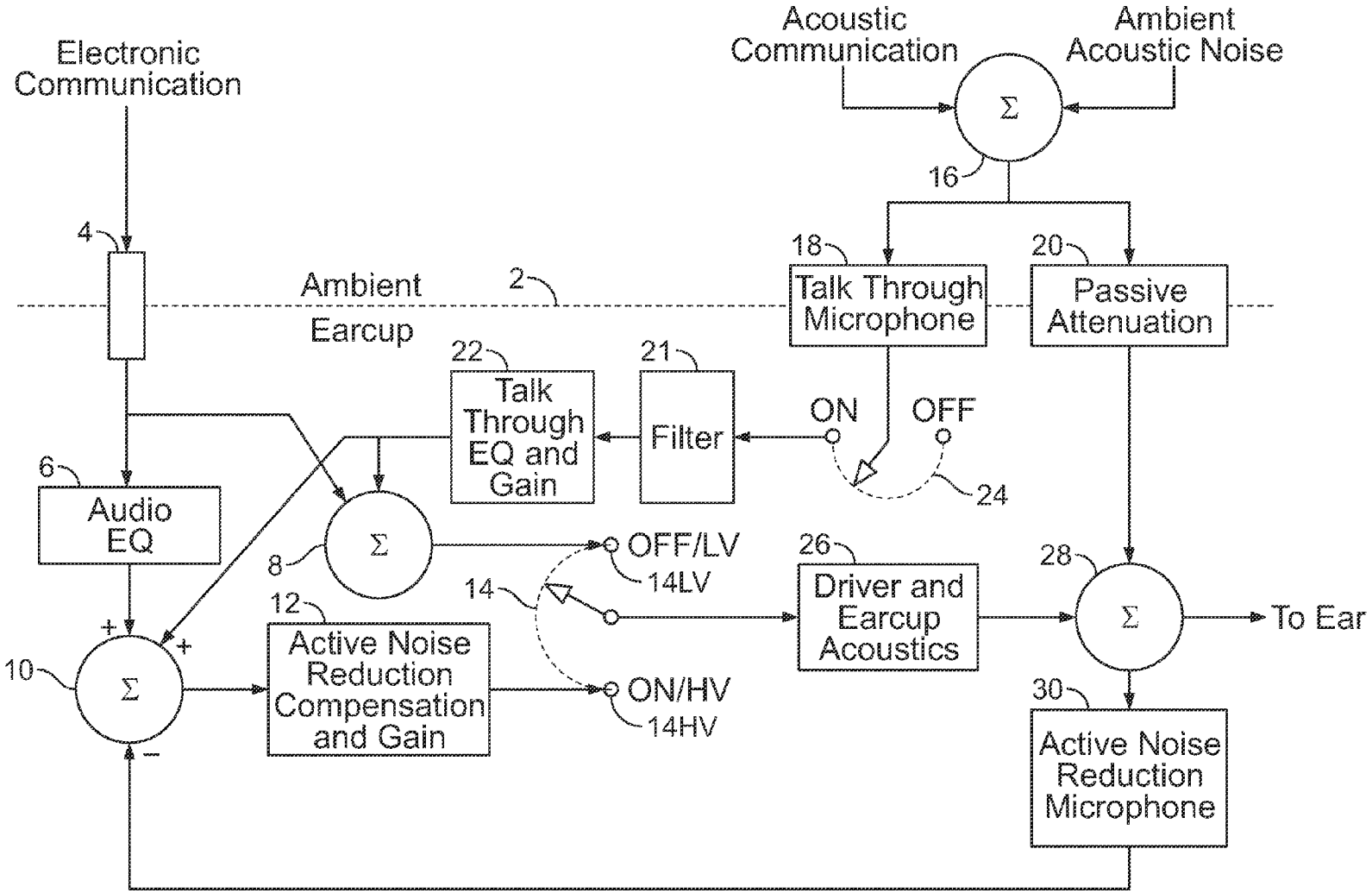
FIGS. 1, 2, and 3 are block diagrams of an active noise reduction headset including "talk-through capability.

Referring to FIG. 1, there is shown a block diagram of an active noise reduction headset with "talk through" capability. Active noise, reduction (ANR) headsets are discussed in U.S. Pat. No. 4,455,675. ANR headsets typically include an earcup that fits in the ear (intra aural), on the ear (supra aural), or around the ear (circumaural). The earcup provides passive attenuation of ambient noise. In addition, ANR headsets include electronic circuitry that significantly attenuates undesired noise, for example by radiating acoustic energy that opposes ambient noise. ANR headsets typically include electronic circuitry to allow electronic communication with the user of the ANR headset.

In FIG. 1, elements above line 2 are elements that are external to the earcup of the headset. Elements below line 2 are internal to the earcup of the headset. Electronic communications terminal 4 is coupled to audio EQ circuitry 6 and to summer 8. Audio EQ circuitry 6 is coupled to summer 10. Summer 10 is coupled to active noise reduction compensation and gain circuitry 12 which is in turn coupled to "HV" (or ON) switch terminal 14HV of switch 14. The ambient sound represented by summer 16 includes acoustic communication and ambient acoustic noise. Ambient sound enters the earcup through two paths; one path includes talk-through microphone 18 and another path is acoustic energy transmitted through the earcup. The earcup passively attenuates that acoustic energy transmitted through it, as represented passive attenuation block 20. Talk through microphone 18 is coupled to talk through band limiting filter 21 and EQ and gain circuitry 22, through optional switch 24, if present. Talk through EQ and gain circuitry 22 is coupled to summers 8 and 10. Summer 8 is coupled to "LV" (or OFF) switch terminal 14LV switch terminal of switch 14. The "HV" and "LV" terminology will be explained below. The acoustic characteristics of the earcup and of the driver (not shown separately in this diagram) are represented by driver and earcup acoustics block 26, which couples switch 14 and summer 28. Passive attenuation block 20 is coupled to summer 28, which is acoustically coupled to active noise reduction microphone 30, which is coupled to summer 10. The block diagram of FIG. 1 shows an exemplary arrangement of elements. Summers 8 and 10 refer to a summation of signals in an element of the circuitry of FIG. 1. Summers 16 and 28 represent a summation of acoustic energy that occurs in the environment and in the volume enclosed by the headset, respectively, and not in a circuit element.

The operation of the ANR headset of FIG. 1 will be described in the discussion of FIGS. 2 and 3.

Figure 2:
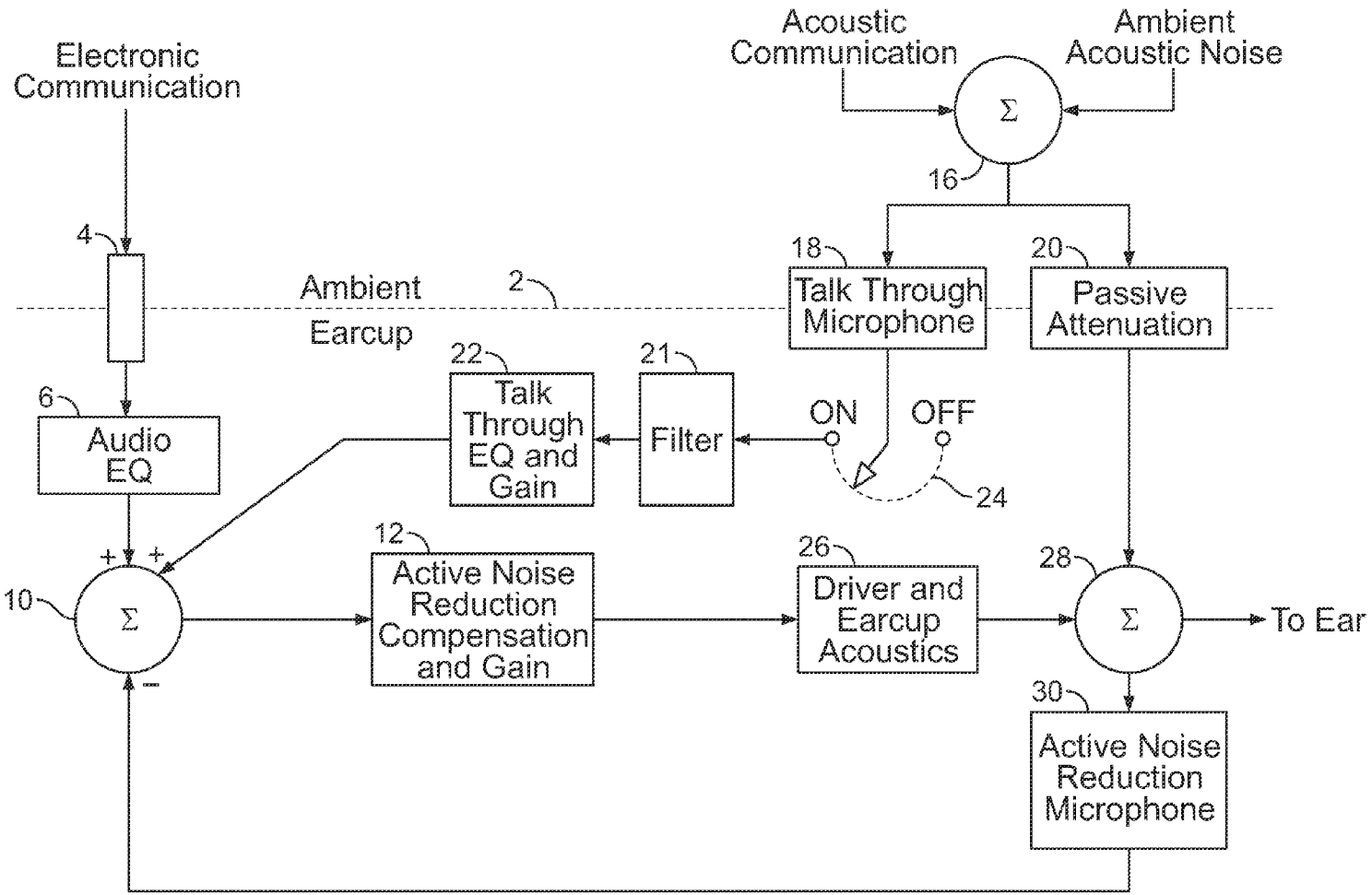

FIG. 2 shows the elements of the ANR headset of FIG. 1 that are active with switch 14 in the "HV" (ON) position. The combined acoustic communication and ambient acoustic noise present in the environment is attenuated by the earcup, as represented by passive attenuation block 20, and at summer 28, becomes a part of a feedback loop as will be described below. Electronic communication from element 4 is equalized at EQ circuitry 6. The signal from the talk-through microphone is band limited at filter 21 and processed by talk-though EQ and gain circuitry 22. The equalized electronic communication signal from EQ circuitry 6 and the equalized, amplified, and band-limited talk-through microphone signal from element 22 are summed at summer 10. Summer 10, ANR compensation and gain circuitry 12, driver and acoustics block 26, summer 28, and ANR microphone 30 form a feedback loop which acts to significantly attenuate sound that does not correspond to the electronic communication signal or the amplified and equalized talk through signal. If switch 24 is in the OFF position, the talk-through feature is substantially disabled and the headset operates as a conventional feedback type ANR headset. In some embodiments, element 22 may include noise removal elements for reducing the content of the signal representing ambient acoustic noise while not reducing the content of the signal representing acoustic communication. Methods and devices for discriminating between acoustic noise and acoustic communication are disclosed in U.S. Pat. Nos. 5,768,473, 5,699,436, 5,481,615, and 5,105,377, U.S. Pat. App. 2001/0046304 and U.S. Pat. App. 2002/0141599.

Other ANR headsets may use ANR circuitry that is feed forward circuitry instead of feedback circuitry.

The band limiting filter 21 may be either a high pass filter or a bandpass filter. A high pass filter would have a break frequency at about the bottom end of the speech band, for example 300 Hz. A band pass filter would have a passband approximating the speech band, for example 300 Hz to 4.5 kHz. Band limiting the signal from the talk through microphone at about the speech band results in the ANR attenuating noise that is outside the speech band while enabling a signal representative of acoustic communication at frequencies within the speech band to be communicated to the user. A high pass filter may also be used, because generally most noise that is desired to be canceled is at low frequencies, and because generally ANR is more effective at low frequencies than at high frequencies.

Figure 3:
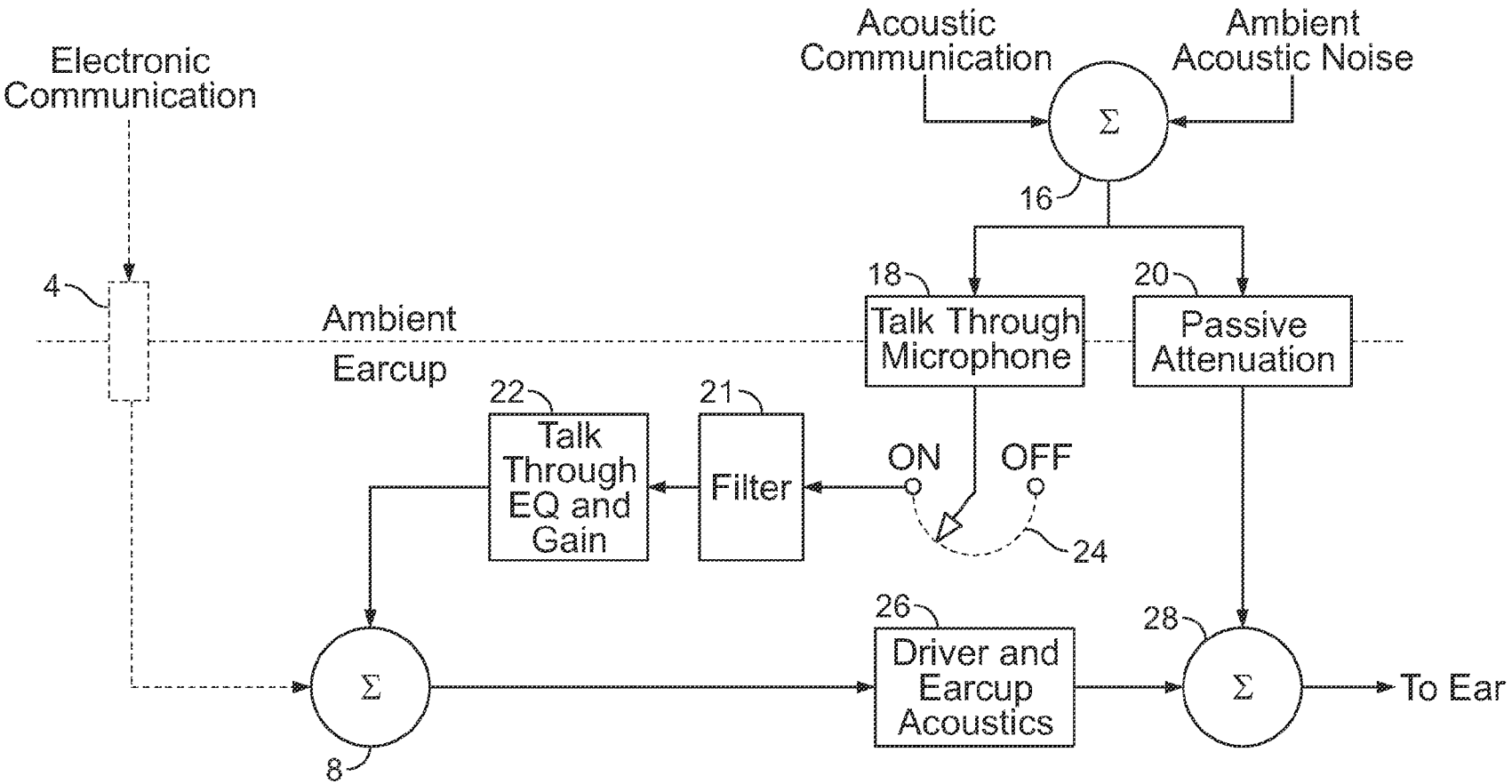
Figure 4A:
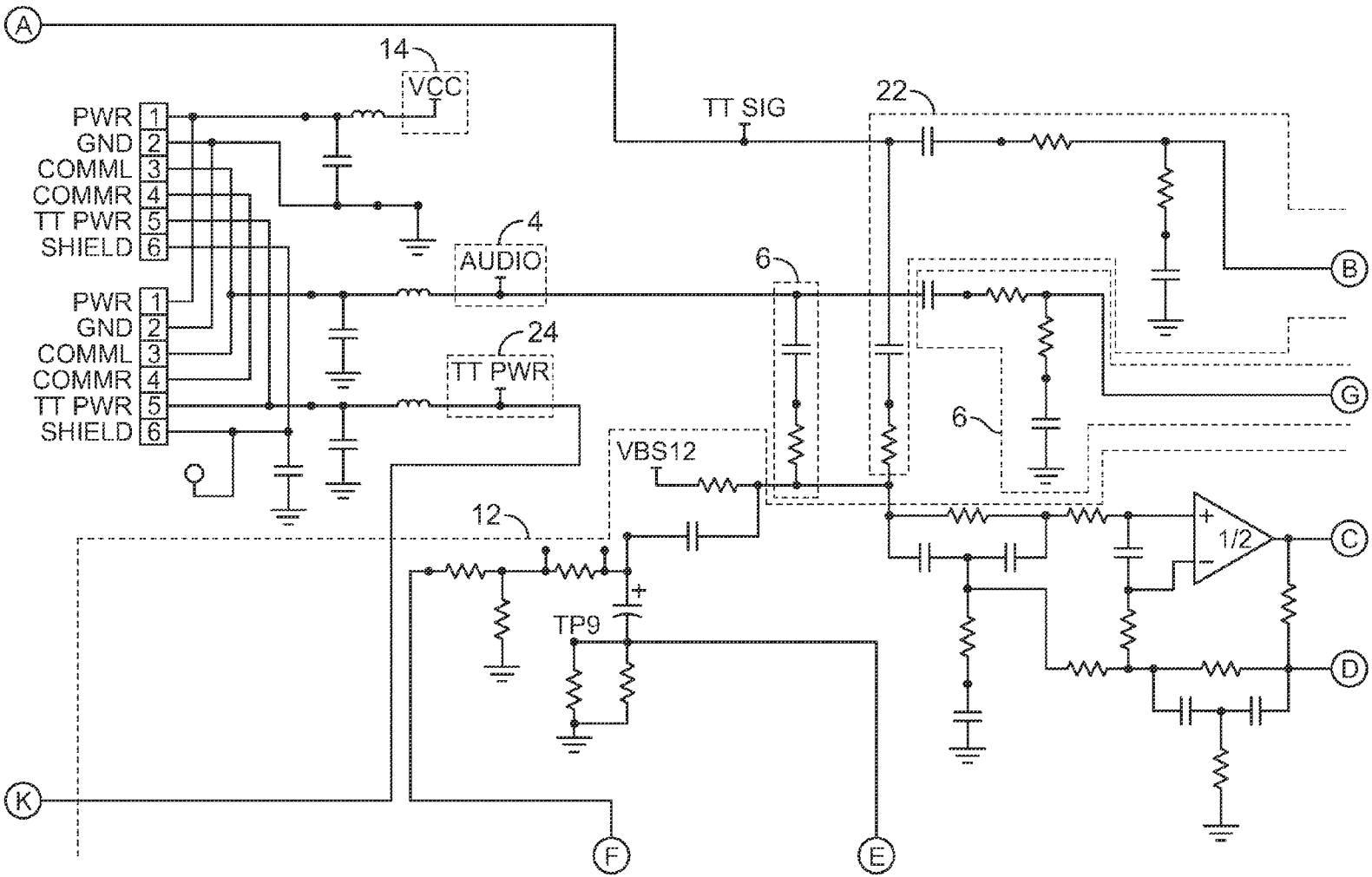
FIGS. 4A, 4B, 4C, 4D, and 4E are parts of a schematic circuit diagram implementing the active noise reduction headset of FIGS. 1-3.
Figure 4B:
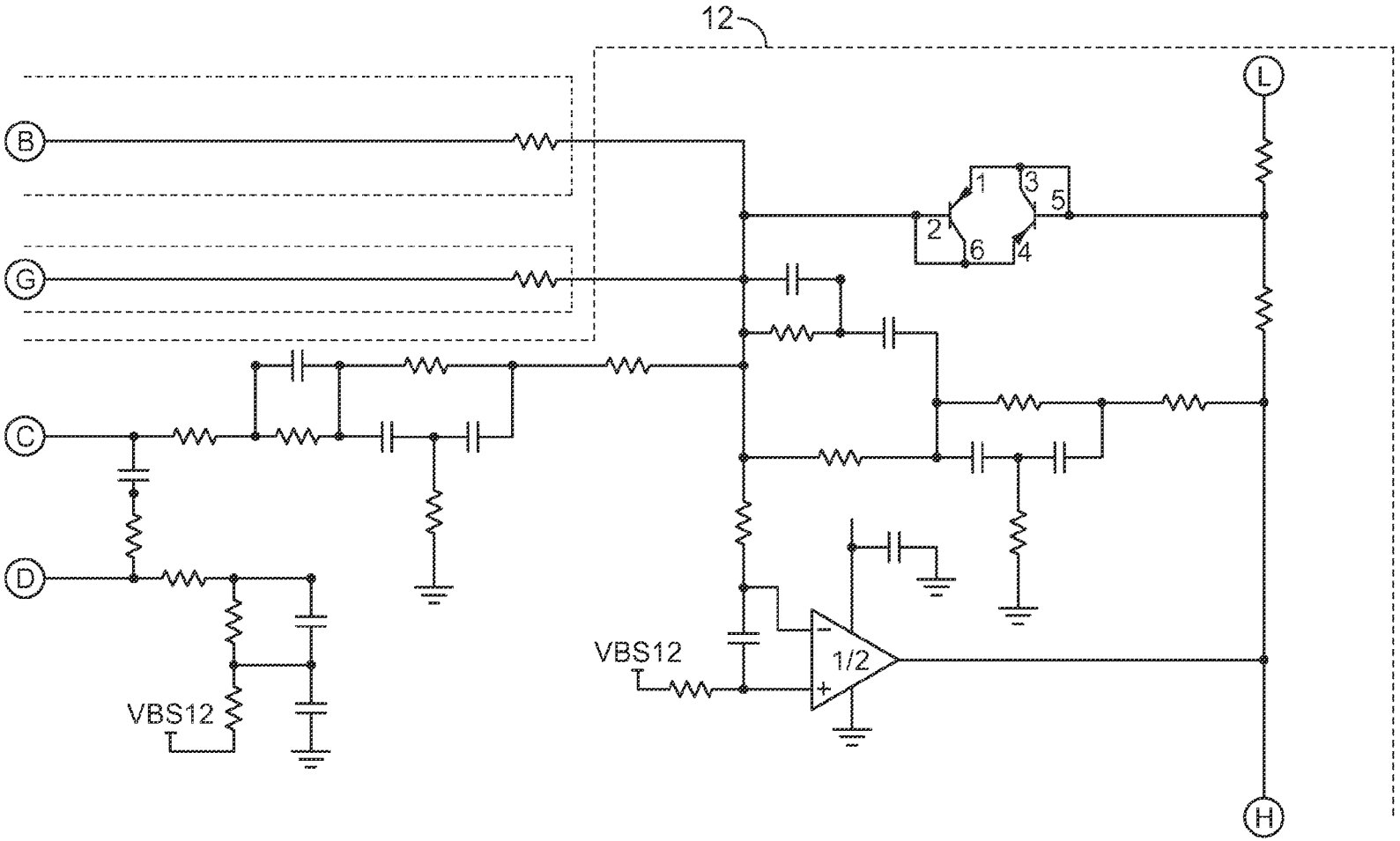
Figure 4C:
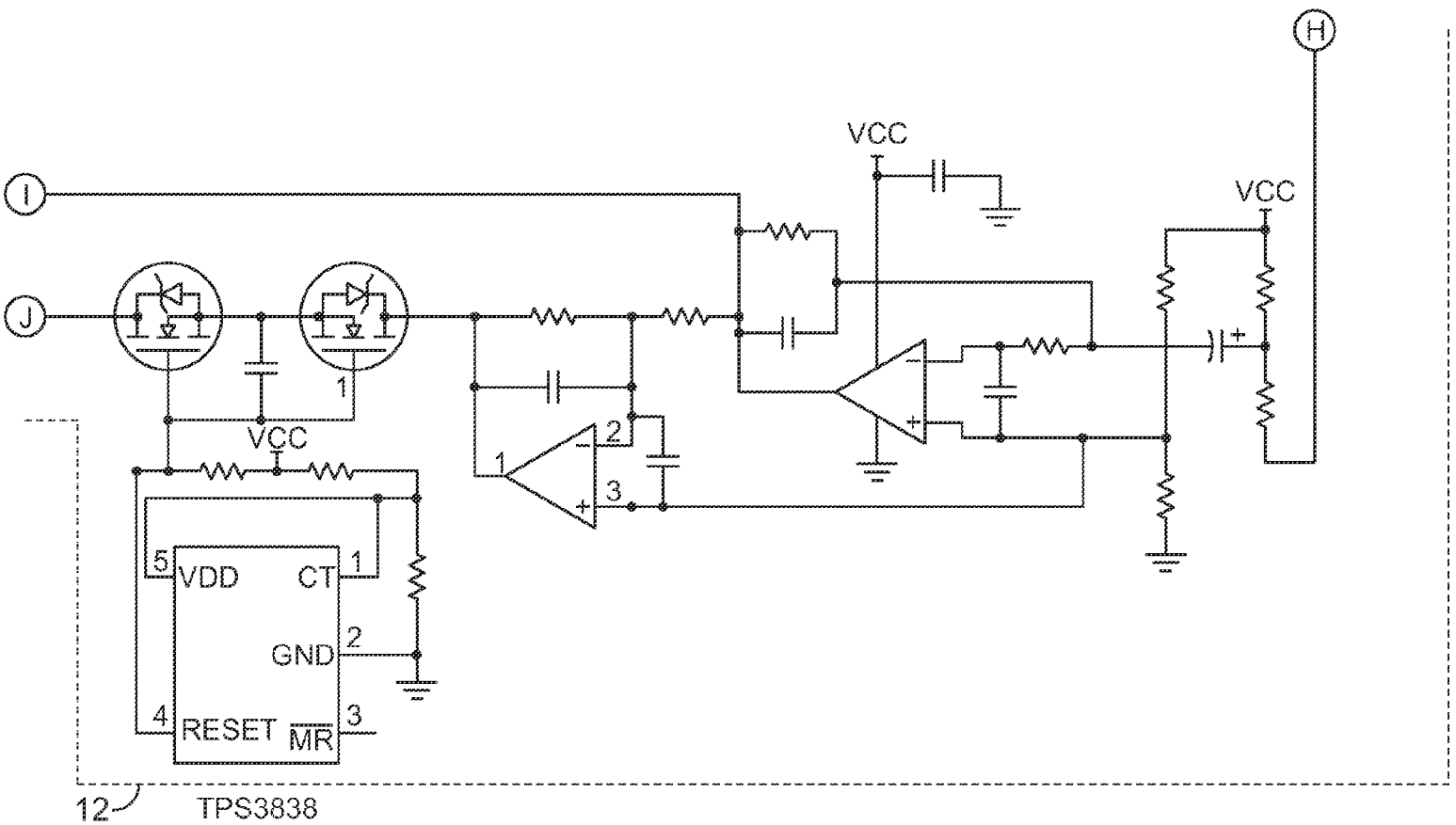
Figure 4D:
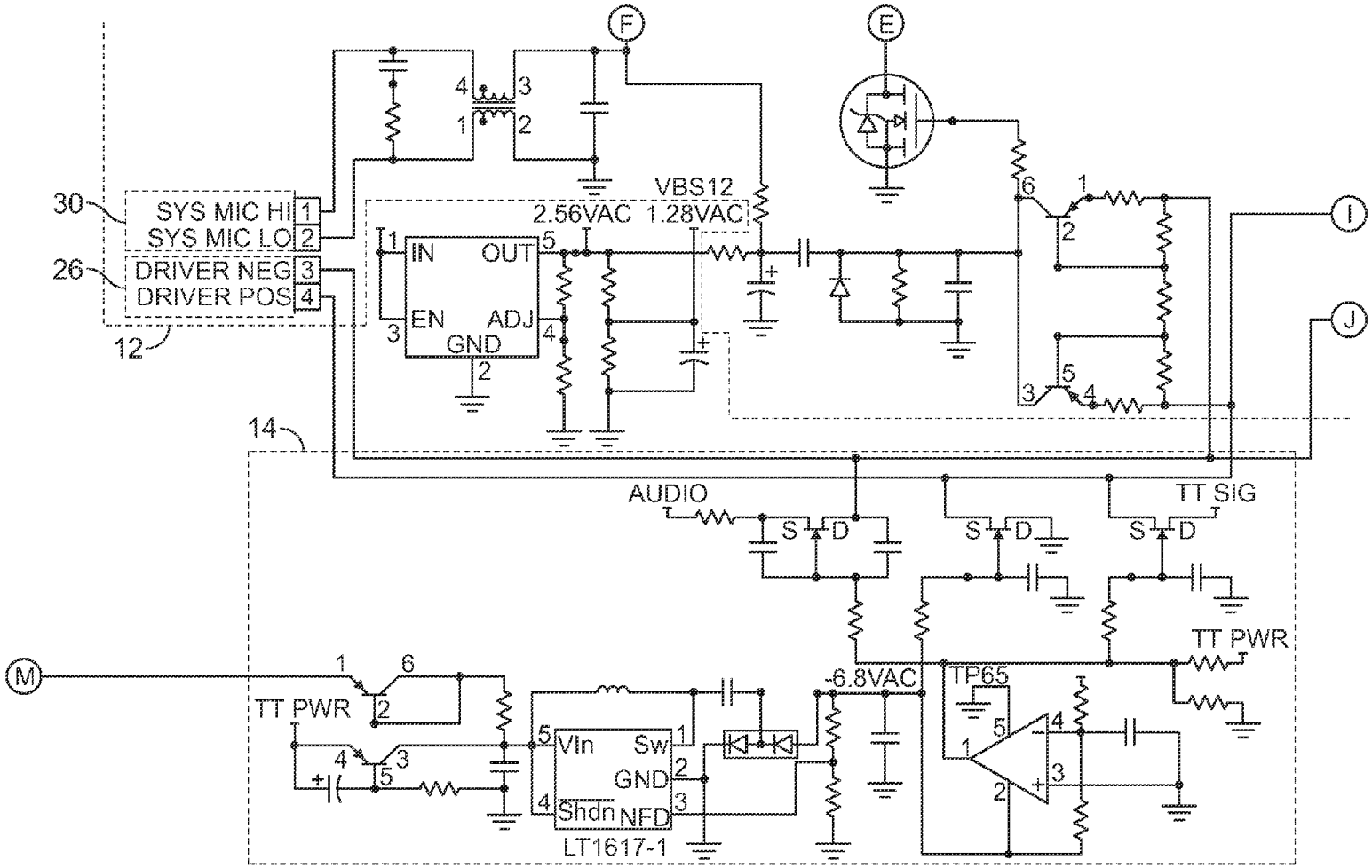
Figure 4E:
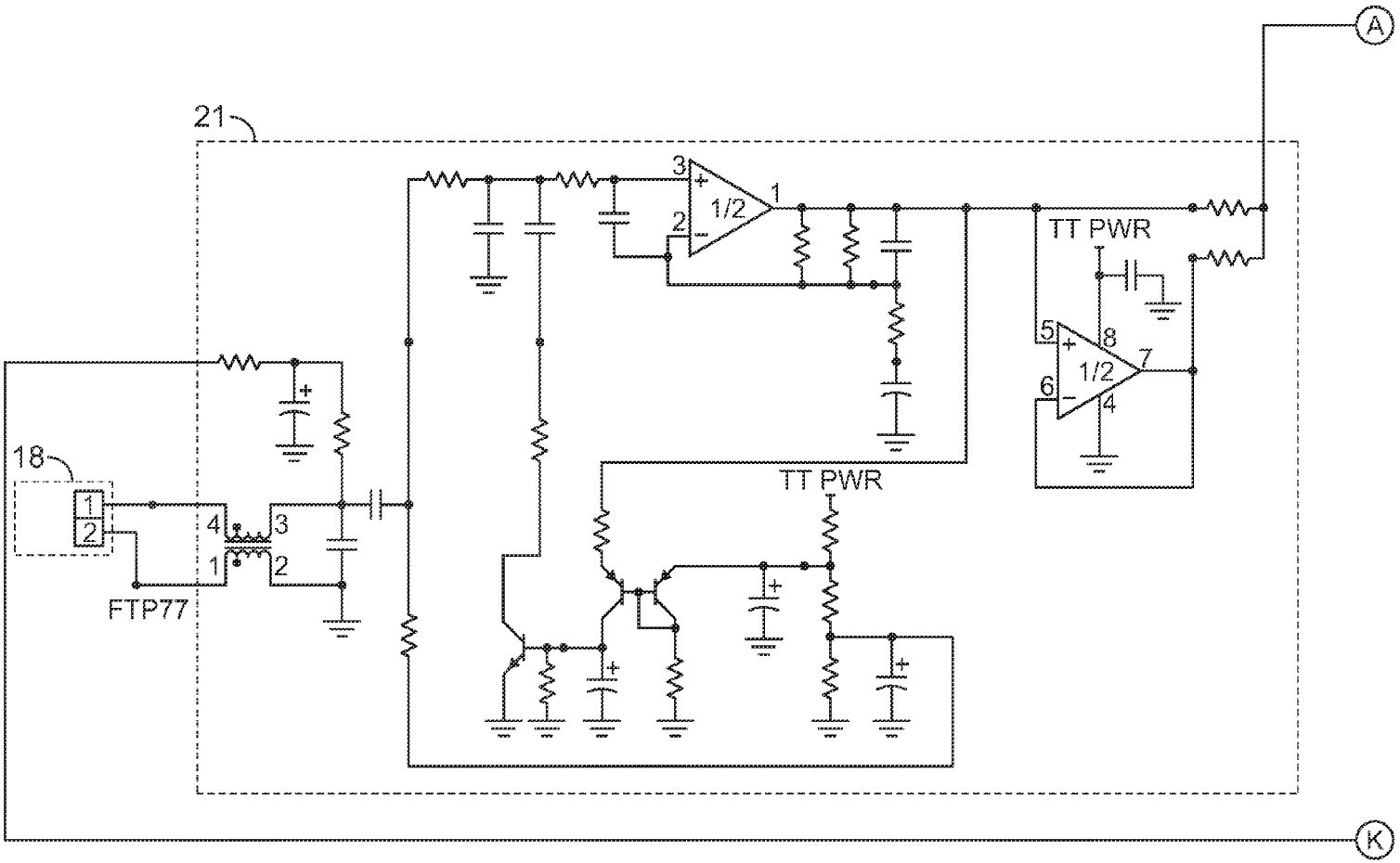

FIG. 3 shows the elements of the ANR headset of FIG. 1 that are active with switch 14 in the OFF or "LV" position. The active noise reduction feedback loop of FIGS. 1 and 2 is substantially disabled, and the headset is operated as a "talk through" headset. Sound corresponding to the band limited equalized and amplified signal from the talk through microphone is radiated to the user's ear. The band limiting by filter 21 facilitates the user hearing acoustic communication, while still retaining the passive attenuation represented by passive attenuation block 20. With switch 24 in the OFF position, the talk through feature is disabled and the headset operates as a passive headset. With the circuit of FIG. 1 and the switch 14 is in the LV or OFF position, the electronic communications terminal 4 may be active. In some embodiments, as will be described below, the LV switch position may be associated with a condition in which there is no signal at the electronic communications terminal 4, so the electronic communications terminal and the coupling to the summer 8 is shown in broken line. In other implementations, the circuitry could be configured so that the electronic communications circuitry functions if the ANR circuitry is not operating.

Switches 14 and 24 may be manual or automated switches. In one implementation, switch 24 is omitted so that, with switch 14 in either the HV position (as in FIG. 2) or in the LV position (as in FIG. 3), the headset has talk-through capability. In one implementation, switch 14 is an automatic switch. If electrical power sufficient to operate the ANR circuitry is supplied to the headset, the headset operates in the manner shown in FIG. 2. If electrical power not sufficient to operate the ANR circuitry but sufficient to operate the talk through circuitry is supplied to the headset, the headset operates in the manner shown in FIG. 3. If the electrical power is not sufficient to operate the ANR circuitry or the talk-through circuitry, then the headset can operate as a passive noise reduction headset, similar to the headset of FIG. 3 with switch 24 in the OFF position. Measuring the electrical power is most conveniently done by measuring the voltage supplied to the headset, so "HV" refers to high voltage and "LV" refers to low voltage. The headset may be configured so that it is connectable to a communications device such as a console, intercom, or a jack in a vehicle, which provides both electrical power to operate the ANR circuitry and the communication signal to the headset; therefore if the headset is not connected to the communications device, the headset receives no electronics communications signal. If the headset is not connected to the communications device, the headset operates as a talk through headset if it is supplied with a source of power (such as a battery) sufficient to operate the talk through circuitry, or as a passive headset if it is not supplied with a source of power sufficient to operate the talk through circuitry.

A headset according to FIGS. 1-3 is advantageous over conventional ANR headsets with talk through capability. A user can be provided with ANR with or without talk through capability; or talk-through capability with or without ANR; or passive attenuation without either ANR or talk-through capability. The switching can be manual, allowing the user to select a desired combination of features, or may be implemented in an automated manner so that, for example, the user selects features by connecting the headset to, or disconnecting from, a communications device or power source.

Referring to FIGS. 4A-4E, there is shown a schematic diagram of a circuit implementing the active noise reduction headset of FIGS. 1-3. FIGS. 4A-4D are the upper left portion, the upper right portion, the lower right portion, and the lower left portion, respectively, of a circuit. The circuit of FIG. 4E connects to the circuit portion of FIG. 4A at points "A' and "K" as shown. Points "L" and "M" connect to elements not germane to this specification. The circuit elements that implement the blocks of FIGS. 1-3 are surrounded by broken lines.

Numerous uses of and departures from the specific apparatus and techniques disclosed herein may be made, including arranging the elements in a different order, without departing from the inventive concepts. Consequently, the invention is to be construed as embracing each and every novel feature and novel combination of features disclosed herein and limited only by the spirit and scope of the appended claims.

What is claimed is:

1. A noise reduction headset, comprising:

active noise reduction signal processing circuitry for attenuating undesired ambient noise;

electronic communication signal processing circuitry for processing communications signals that enter the headset through an electronic communications terminal to reach a wearer of the headset;

talk-through signal processing circuitry for permitting a wearer of the headset to hear acoustic communication from the ambient environment, comprising at least one talk-through microphone separate from the electronic communication signal processing circuitry; and a switching element providing a first operating mode with the talk-through signal processing circuitry, the active noise reduction signal processing circuitry, and the electronic communication signal processing circuitry enabled;

a second operating mode with the talk-through signal processing circuitry and the electronic communication signal processing circuitry enabled and the active noise reduction signal circuitry disabled; and a third operating mode with the talk-through signal processing circuitry disabled and the active noise reduction signal processing circuitry and the electronic communication signal processing circuitry enabled.

2. A noise reduction headset in accordance with claim 1, wherein the switching element is for disabling the noise reduction signal circuitry and wherein the switching element is constructed and arranged to be automatically responsive to the power supplied to the headset.

3. A noise reduction headset in accordance with claim 2, wherein the switching element disables the noise reduction signal processing circuitry when the power applied to the switching element is insufficient to operate the noise reduction signal processing circuitry.

4. A noise reduction circuit in accordance with claim 1, wherein the talk-through signal processing circuitry comprises a microphone and a frequency selective filter for filtering input from the microphone, the filter constructed and arranged to significantly attenuate frequencies below the speech band.

5. A noise reduction circuit in accordance with claim 1, further comprising a filter constructed and arranged to significantly attenuate frequencies not in the speech band.

6. A noise reduction headset comprising:

a first signal path, including active noise reduction, reception of electronic communications, and talk-through;

a second signal path, including talk-through and reception of electronic communications and not including active noise reduction;

a selection circuit constructed and arranged to select either the first signal path or the second signal path.

7. A noise reduction headset in accordance with claim 6, further comprising:

a third signal path, including active noise reduction and not including talk-through, where in the selection circuit is constructed and arranged to select one of the first signal path, the second signal path, or the third signal path.

8. A noise reduction headset in accordance with claim 1, the talk-through signal path comprising a microphone separate from the electronic communication signal processing path and the noise reduction headset further comprising a frequency selective filter for filtering input from the microphone, the filter constructed and arranged to significantly attenuate frequencies not in the speech band.

9. A noise reduction headset in accordance with claim 8, wherein the frequency selective filter is a high pass filter.

10. A noise reduction headset in accordance with claim 8, wherein the frequency selective filter is a band pass filter.

11. A noise reduction headset in accordance with claim 8, further comprising an element for removing noise from the signal in the talk-through signal path.

12. A noise reduction headset in accordance with claim 1, further comprising:

circuitry for monitoring the electrical power to the headset;

circuitry responsive to the electrical power to the headset dropping below a first threshold level automatically disabling the active noise reduction signal processing circuitry.

13. A noise reduction headset in accordance with claim 12, further comprising circuitry responsive to the electrical power supplied to the headset being above a second threshold for disabling the active noise reduction control signal processing circuitry and enabling the talk-through signal processing circuitry.

14. A noise reduction headset in accordance with claim 13, further comprising circuitry responsive to the electrical power supplied to the headset being below the second threshold, disabling the talk-through signal processing circuitry.

* * * * *